US007503151B2

(12) United States Patent
Simmons

(10) Patent No.: US 7,503,151 B2
(45) Date of Patent: Mar. 17, 2009

(54) BUILDING FRAME WITH OPEN/OPENABLE-TOP, HOLLOW, TUBULAR COLUMN STRUCTURE

(76) Inventor: Robert J. Simmons, 27308 Fairview Ave., Hayward, CA (US) 94542

( * ) Notice: Subject to any disclaimer, the term of this patent is extended or adjusted under 35 U.S.C. 154(b) by 784 days.

(21) Appl. No.: 10/750,708

(22) Filed: Jan. 2, 2004

(65) Prior Publication Data

US 2004/0139682 A1 Jul. 22, 2004

Related U.S. Application Data

(60) Provisional application No. 60/438,882, filed on Jan. 8, 2003, provisional application No. 60/460,623, filed on Apr. 3, 2003.

(51) Int. Cl.
*E04H 12/02* (2006.01)
*E04H 12/00* (2006.01)

(52) U.S. Cl. ..... 52/745.17; 52/749.1; 52/122.1; 52/125.2; 52/123.1

(58) Field of Classification Search ..... 52/122.1, 52/111, 121, 123.1, 125.2, 125.6, 749.1, 52/745.17, 651.1
See application file for complete search history.

(56) References Cited

U.S. PATENT DOCUMENTS 2,203,113 A * 6/1940 Uecker et al. ..... 212/179
2,921,442 A * 1/1960 Laborde et al. ..... 405/207
3,091,937 A * 6/1963 Thompson et al. ..... 405/204
3,732,655 A * 5/1973 Termohlen et al. ..... 52/73
3,878,662 A * 4/1975 Cernosek ..... 52/745.18
3,952,527 A * 4/1976 Vinieratos et al. ..... 405/217
3,980,037 A * 9/1976 Tuson ..... 114/230.14
4,040,265 A * 8/1977 Hellerman et al. ..... 405/196
4,064,669 A * 12/1977 Vik ..... 52/299
4,108,583 A * 8/1978 Ellen ..... 425/65
4,142,819 A * 3/1979 Challine et al. ..... 405/196
4,192,110 A * 3/1980 Michel et al. ..... 52/111
4,629,365 A * 12/1986 Kuriiwa ..... 405/204
5,012,627 A * 5/1991 Lundmark ..... 52/745.04
5,445,487 A * 8/1995 Koscinski, Jr. ..... 414/543
6,226,955 B1 * 5/2001 Lorrigan ..... 52/745.05
6,668,497 B1 * 12/2003 Mayer et al. ..... 52/126.1

* cited by examiner

*Primary Examiner*—Phi Dieu Tran A
(74) *Attorney, Agent, or Firm*—Jon M. Dickinson, PC; Robert D. Varitz, PC

(57) ABSTRACT

A building frame including a load-bearing portion which is defined by a pattern of interconnected, elongate, upright columns and laterally extending beams, with each column taking the form of an assembly of hollow, tubular column components, at least some of which each possesses a nominally open, upper-end utility region, or port, extending upwardly beyond the top of the frame's load-bearing portion. Each such port, which is useable in different ways during and after initial building construction, accommodates, under different circumstances, the selective reception of a construction-extension instrumentality drawn from the list consisting of (a) an installable/removable crane structure, (b) a column-like element provided for the addition of selected building superstructure, and (c) additional building infrastructure which is feedable downwardly through the port toward a selected elevation in a "completed" building.

1 Claim, 2 Drawing Sheets

BUILDING FRAME WITH OPEN/OPENABLE-TOP, HOLLOW, TUBULAR COLUMN STRUCTURE

CROSS-REFERENCE TO RELATED APPLICATIONS

This application claims priority to two prior-filed, currently pending U.S. Provisional Patent Applications whose contents are hereby incorporated herein by reference. These two applications are Ser. No. 60/438,882, filed Jan. 8, 2003, for "Hollow-Tube Column-Top Davit Structure", and Ser. No. 60/460,623, filed Apr. 3, 2003, for "Column Penetration of Building Roof Structure and Method". The inventorship in those two prior cases is the same as in the present case.

BACKGROUND AND SUMMARY OF THE INVENTION

This invention relates to plural-story building structure, and more particularly to features in a novel column structure which forms part of the frame in such a building structure, which features uniquely allow for the implementation of several categories of what are referred to herein as construction-extension activities. This invention possesses both structural and methodological characteristics.

Considering one facet of the invention, in the construction of a plural-story building, it is common practice to employ large and expensive ground-supported cranes (as few as possible) to lift and swing into position various building materials, including frame building materials. There is, of course, normally much to lift during the progress of such building construction, and it would be very desirable that not all of the myriad lifting events be "loaded" onto the work "agenda" of a major crane, especially where many lifting requirements could more efficiently be handled by carefully placed, small crane-like machines.

As will be seen shortly, the present invention squarely addresses this issue in a simple, versatile and efficient manner. It does so by providing a unique hollow and tubular column structure. Wherein the upper open end of a column component can be employed, in a temporary manner, as a stabilizing receptacle for the base of a small and highly portable davit-like crane, referred to hereinafter as a davit crane. Such a crane is also referred to herein as a building-extension, or construction-extension, instrumentality because of the fact that its use is involved, in a futurist manner of thinking, in the prospective extension of building activity.

Further, and considering other facets of the invention, after a plural-story building has been completed, and effectively sealed against invasion by the elements, there are many instances in which it is later desirable to add superstructure (more upper stories, a canopied roof space, etc.) to the top of the "once completed" building. Additionally, it may later be desirable to introduce some additional internal building structure (cables, fluid conduit, and other things) without significantly having to "break-open" the environmentally sealed condition of a building, and in particular breaking-open the sides of a building.

The present invention also handily addresses these kinds of "construction-extension" activities.

The preferred and best-mode embodiment of, and manner of practicing, the invention may best be appreciated in the context of describing first certain special terminology which is employed herein in the description and characterization of the invention. One such terminology feature is expressed in the phrase "construction-extension", and a definitional basis for this phrase has already been given above. Text below will reinforce this definitional basis.

Another special terminology component herein involves the phrase "load-bearing portion" in relation to the frame of a plural-story building structure. As employed herein, this phrase refers to that volumetric portion of a building frame which is occupied by interconnected columns and beams that are intended to handle various loads delivered into that volume region of the frame. The phrase does not include the parts of any frame components—and in particular, column components—which project upwardly and freely above the top of the associated, underlying frame volume which contains load-bearingly interconnected columns and beams. This definition will become more clearly illustrated in the detailed description of the invention below.

According to a preferred and best-mode embodiment of, and manner of practicing, the invention, columns for a plural-story building frame are constructed as hollow, tubular components. In whatever stage of building-frame completion "currently" exists, upper end regions in installed columns extend above what is referred to herein as the load-bearing portion of a building frame structure. Such a load-bearing portion is defined as that portion of a building frame which contains load-bearingly interconnected columns and beams.

In a frame structure which is not yet complete, and thus is still under construction, each column's upper end region can be visualized as extending above a certain previously completed load-bearing part of a load-bearing portion of an underlying frame structure.

In a completed building, and in accordance with the present invention, such upper end regions in columns extend above, and thus penetrate, the roof of the underlying completed building. Appropriate weather sealing is provided where such column ends extend upwardly from the roof.

These column upper end regions nominally each terminates at an open, upwardly facing, upper end, referred to herein as a mouth. Such a mouth opens to the underlying hollow interior of the upper end region in the associated column component, and together with that interior defines what is referred to herein as a port. In a finished building, these mouths are closed off and environmentally sealed by appropriate, removeably installed plugs. While a building frame is still under construction, the column mouths are normally left open.

It is these port-containing upper-end column regions which facilitate the activity which is referred to herein as construction-extension activity. While a building frame is still under construction, the ports provided by these regions allow for the temporary, removable installation of portable crane structures, such as davit crane structures, which can be employed to assist "locally" with various construction-extension tasks. In this kind of situation, the underlying building frame structure effectively acts as a supporting mast, or tower, for the installed crane.

In a finished building, sealing caps may be removed from the upwardly extending column end regions to enable, and ultimately become part of, added building superstructure, such as additional building stories, a roof canopy structure, and other things, which become supported by the column end extension. These upwardly extending column end regions, and the accessible ports which they provide, can also offer structural mounting points for various kinds of mechanical equipment, for towers, terraces and decks, to name just a few, possible, added rooftop structures, and additionally can accommodate the removable and resettable installations of davits and similar load-handling devices to support window-washing and painting platforms, and the like.

Still further, post-building opening of the upper end region (port) in an upwardly extending column end, thus to expose this port for use, can enable downward feeding of various kinds of later-desired building infrastructure. Such an opening, significantly, does not entail any appreciable compromise in the sealed environment condition of a previously finished building. Its availability avoids the undesirable necessity for breaking-open side regions in a finished and "closed" building.

These and other features and advantage which are offered by the present invention will become more fully apparent as the detailed description which now follows is read in conjunction with the accompanying drawings. Throughout these drawings, like structural elements pictured in the different figures are identified with like reference numerals and characters.

DESCRIPTION OF THE DRAWINGS

In FIGS. 3-6, inclusive, a roof-installed waterproof membrane (which is pictured in FIGS. 2A and 2B) is omitted in order to simplify these views.

DETAILED DESCRIPTION OF THE INVENTION

Figure 1:
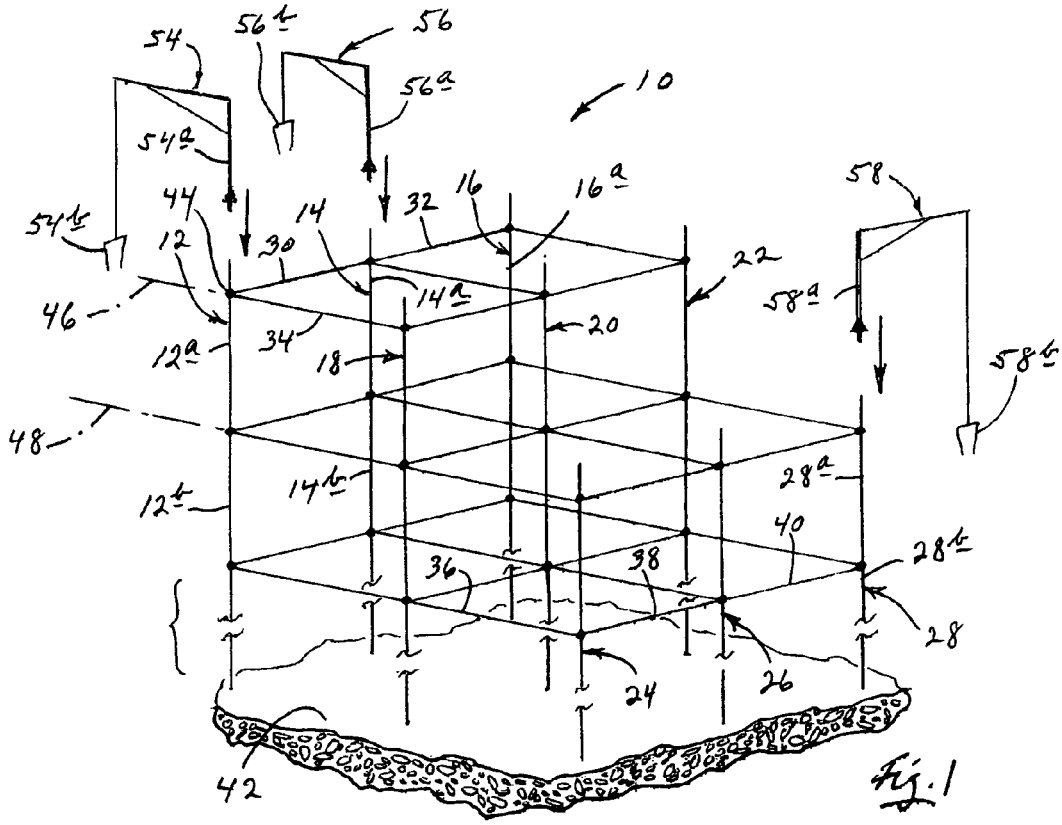
FIG. 1 is a simplified, fragmentary, isometric illustration of an incomplete building structure, including specifically a frame which is under construction, and which includes columns formed with column components constructed in accordance with a preferred and best-mode embodiment of the present invention.
Figure 2A:
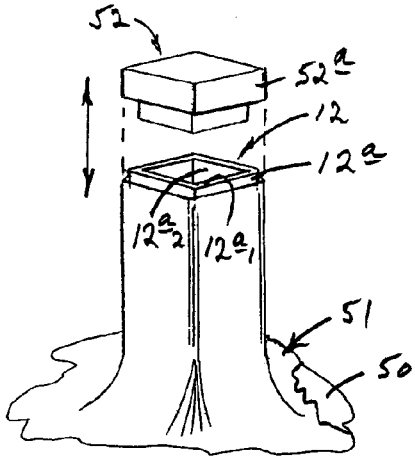
FIG. 2A is an enlarged, fragmentary, roof-area detail of a portion of the building structure of FIG. 1, shown here in a nominally completed, or finished, state, and specifically illustrating a fragment thereof including an above-the-roof-projecting column component disposed in the building structure in accordance with the present invention.

Turning now to the drawings, and beginning with FIGS. 1 and 2A, indicated generally at 10 in FIG. 1 is a plural-story building frame which is under construction. In the stage of construction illustrated (fragmentarily) in FIG. 1, frame, or frame structure, 10 is seen to include plural upright columns 12, 14, 16, 18, 20, 22, 24, 26, 28, and plural, horizontally extending beams, such as the six beams specifically identified at 30, 32, 34, 36, 38, 40. The columns rise from an anchoring foundation 42, and in the specific frame structure pictured in FIG. 1, each column takes the form of plural (an assembly of) vertically stacked and appropriately joined single-story columns components, such as components 12*a*, 12*b* in column 12, 14*a*, 14*b* in column 14, 16*a*, 16*b* in column 16, and 28*a*, 28*b* in column 28. These column components, and hence the resulting associated columns, are square in cross section, and are hollow and tubular. This is best illustrated in FIG. 2 for column component 12*a*.

In frame structure 10 as illustrated in FIG. 1, the columns and beams are appropriately load-bearingly interconnected at nodes, such as node 44 where column 12 connects with beams 30, 34. To simplify FIG. 1, and because these nodal connections form no part of the present invention, each connection node is represented herein simply as an enlarged, darkened dot in FIG. 1.

Important to the practice and implementation of the present invention are the facts that columns, and thus their column components, are, as indicated, hollow and tubular, and at least at certain points in time, as during frame construction, are open-topped. Squareness of cross section is not important, which is another way of stating that other cross sections may be employed as well, if desired.

Referring especially to FIG. 2A which pictures a portion of upper column component 12*a* where that component projects above the top of the roof (still to be discussed) in a "completed" building based upon frame 10, the openness of the top of this component is defined by a mouth $\mathbf{12}a_1$, which opens to the upwardly facing upper hollow interior region $\mathbf{12}a_2$. Mouth $\mathbf{12}a_1$ and region $\mathbf{12}a_2$ collectively form what is referred to herein as a port, and also as a utility region. This characteristic is preferably the same for all "currently" upper column components in frame 10 during construction. The ports thus provided according to the invention enable the several construction-extension activities mentioned earlier herein. More will be said about these ports shortly.

Considering the status of frame 10 as illustrated in FIG. 1, the volumetric portion of the frame which is defined and occupied by load-bearingly interconnected columns and beams is referred to herein as a load-bearing portion of the frame. With regard to the higher elevation column components (i.e., those in columns 12, 14, 16, 18, 20, 22) pictured in FIG. 1, the entirety of what is shown for frame 10, that is, the entirety of the illustrated frame structure which lies below elevation 46 (marked by a dash-dot line), constitutes a relevant load-bearing portion of the frame. With respect to the pictured lower-elevation part of frame 10, that is, the part containing column 28, the relevant load-bearing part of frame 10 is that part which lies below elevation 48 (also marked by a dash-dot line). Elevations 46, 48 thus define the tops of two different load-bearing portions of frame 10.

As can be seen with respect to these two identified frame elevations, the upper ends of related upper column components project, or extend, somewhat above these elevations. Thus the respective ports in these upper column components are open for access above these mentioned elevations. While such upward projection characteristics are preferable throughout the entirely of frame construction, it is only necessary that ultimately the finishing and uppermost column components possess this characteristic so that upper end regions, and the associated ports (utility regions), will end up extending above a completed building roof, During construction, and at elevations which are below roof level, it is only important that upper column-component end regions be open to furnish accessible utility ports in accordance with the present invention.

Figure 2B:
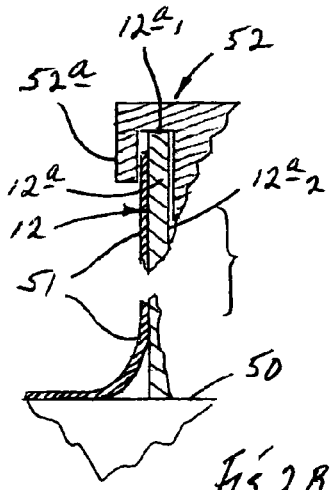
FIG. 2B is a further enlarged, fragmentary detail, partly cross-sectioned, focusing on portions of what is pictured in FIG. 2A under circumstances with a weather closure cap mounted in place on the upper end of the above-the-roof-projecting column component.

Re-addressing FIG. 2A for a moment, and adding reference here also to FIG. 2B, and further, assuming that the upper-most column components, such as components 12*a*, 14*a*, 16*a*, define the uppermost story in the building for which frame 10 has been constructed, and additionally that the associated building is complete, the upper end regions of these uppermost column components extend upwardly through and beyond the building roof which is shown generally at 50 in FIGS. 2A, 2B. The upper end of column component 12*a*, as such is illustrated in these two figures, roof 50, and the regions surrounding the upwardly projecting column components, are fully weather sealed by the presence of an appropriately installed waterproof membrane 51. This membrane covers the upwardly facing surface area of the roof, and "curls upwardly", and sealingly, along the sides of projecting column components, as is illustrated for the sides of column component 12*a* in FIGS. 2A, 2B. The nominally open, upwardly facing ends of the projecting column components are reversibly closed and weather sealed by appropriate removable caps, such as cap 52 for column component 12*a*. These caps are configured, as can be seen for cap 52 in FIG. 2B, with downturned perimeter skirts, such as skirt 52*a*, each of which skirts, with the associated cap in place, sealingly overlaps both the upper open end of a column component, and the adjacent, upwardly extending portion of membrane 51.

One can thus see that after nominal completion of a building, the utility access ports provided by the structure and practice of the invention are available at roof level. Such ports are thus available for use (at different locations in a building frame) essentially throughout the "life" of a building frame possessing them.

Figure 3:
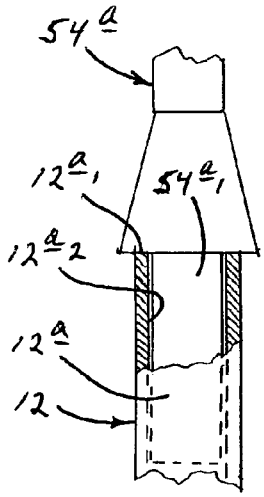
FIG. 3 is an enlarged, fragmentary detail illustrating temporary installation of a davit crane in accordance with a practice which is enabled by the present invention.

Important aspects of the utility of the present invention will now be described. Beginning with FIGS. 1 and 3, shown generally at 54, 56, 58 in FIG. 1 are three portable (temporary-use) davit crane structures, or construction-extension instrumentalities, whose upright masts, 54*a*, 56*a*, 58*a*, respectively, are shown poised above the upwardly facing utility ports that are provided by column components 12*a*, 14*a*, 28*a*, respectively. Downward pointing arrows provided in FIG. 1 near the bases of these masts represent the fact that these bases, appropriately configured in any suitable conventional manner, can be lowered downwardly to become removeably received and stabilized in (connected to) the underlying ports. FIG. 3 shows the base $\mathbf{54}a_1$ in mast 54*a* so received in port $\mathbf{12}a_1$-$\mathbf{12}a_2$ in column component 12*a*. Preferably, and as in shown in FIG. 3, such a "connection" is a lateral moment connection.

With temporary installation of cranes 54, 46, 48, their respective booms and associated load-handling implements 54*b*, 56*b*, 58*b* can be maneuvered to assist conveniently and efficiently with building construction. One will observe that with a crane, such as cranes 54, 56, 58, installed for use, the building frame supporting each crane mast effectively becomes a part of the supporting mast structure.

Cranes can be installed and moved from location to location (port to port) as desired, and an in-place crane can be employed to move and reposition another crane. For example, crane 56 might be employed to remove crane 54 from its installation with column component 12*a*, and to move it for re-installation into the open port in column component 16*a*. Cranes, and the like, may also be installed for use from a building rooftop after building completion, if desired, simply by removing the cap covering the appropriate utility port. Installation and use of a crane in accordance with practice of the invention, and at any stage during the life of a building, is referred to herein as construction-extension activity.

Figure 4:
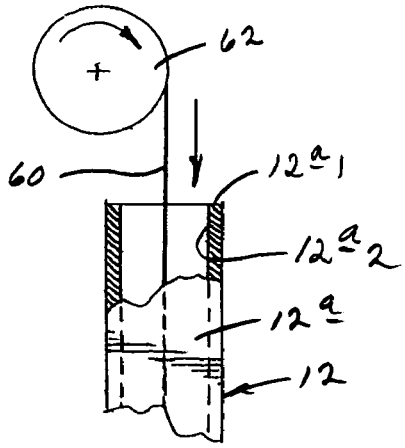
FIG. 4 illustrates employment of the invention to enable the addition (through column structure) to a completed building of additional infrastructure in the form of cabling.

FIG. 4 illustrates another category of construction-extension activity which is enabled by the invention. Here, it is desired to introduce, downwardly into a completed, or substantially completed, building, and toward a selected elevation in the building, certain additional building infrastructure, such as cabling (also referred to herein as a construction-extension instrumentality). In particular, it is desired to do this without having to break significantly through the "outer skin" of the building, which event could be quite expensive, and could appreciably compromise a building's weather-sealed condition. Thus, in FIG. 4 cap 52 (not shown in this figure) has been removed from column component 12*a* to allow for the downward feeding, through the thus-exposed port, of cabling 60 which is appropriately payed out from a drum 62.

Figure 5:
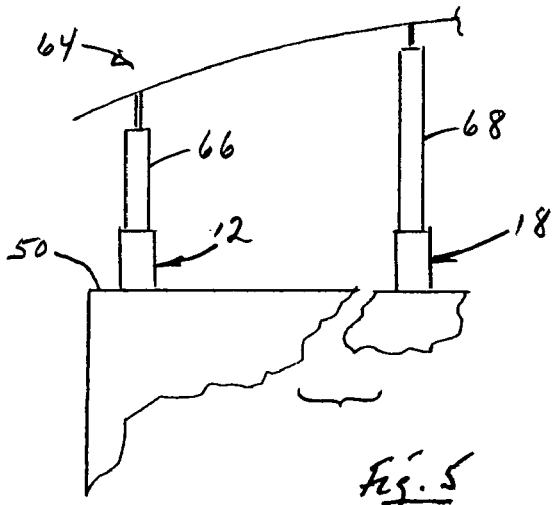
FIGS. 5 and 6 are simplified and fragmentary side elevations of a portion of a completed building, illustrating employment of the invention to accommodate the later addition, respectively, of a canopy superstructure which rises from the "former" top of that building, and of columns to support additional stories.
Figure 6:
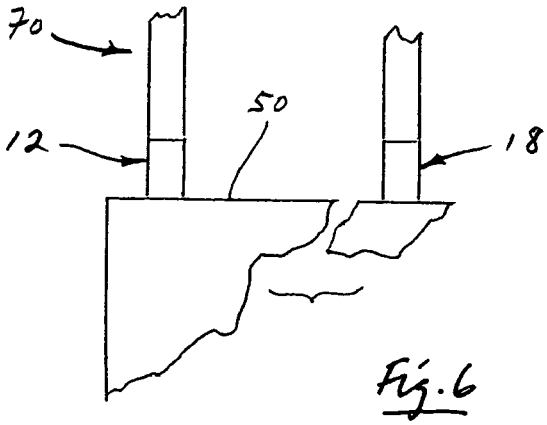

FIGS. 5 and 6 picture two different versions of yet another construction-extension practice which may be implemented with respect to a "finished" building.

FIG. 5 specifically illustrates the addition (construction-extension) above roof 50 of a canopy structure 64 which includes upright support pillars, such as pillars 66, 68, which have been suitably installed in the upwardly facing ports provided at the tops of through-the-roof projecting columns, such as columns 12, 18, respectively. To achieve this, of course, the once installed closure caps for these column tops have been removed. Where the support pillars for this canopy structure "emerge" from the associated column tops, the interfaces between them are appropriately re-sealed. These support pillars are also referred to herein both as construction-extension instrumentalities, and as column-like elements.

FIG. 6 shows how the ports in column tops can allow for the later addition to a building of one or more stories. One new building story is shown generally and fragmentarily at 70. Caps for the requisite ports are removed, and new columns are added as required. Such new columns are also referred to herein as construction-extension instrumentalities, and as column-like elements.

The invention thus proposes a novel building structure wherein hollow tubular columns furnish upwardly facing ports for receiving various types of structures that allow for the kinds of building construction-extensions activities which have been described and illustrated. In a "finished" building, column tops extend upwardly through the roof in a building to permit later "utility access" for various construction purposes.

I claim:

1. A deployable-crane building method for use in fabricating a site-built, plural-story building comprising providing a column-and-beam structural building frame having elongate, nodally interconnected, upright columns and generally horizontal beams, providing in at least one of these columns, substantially immediately above a nodal connection between this at least one column and a horizontally extending beam, an open, upwardly facing end, removeably seating the base of a load-handling crane within the mentioned open column end, and utilizing the frame of nodally interconnected columns and beams, including the mentioned nodal connection which exists between the at least one column and the mentioned horizontally extending beam, furnishing direct load-bearing support for any such base-seated crane, with seating of a crane base in such an open column end furnishing the totality of lateral stabilization and support for the seated crane.

* * * * *